US005333756A

United States Patent [19]

Glasa

[11] Patent Number: 5,333,756

[45] Date of Patent: Aug. 2, 1994

[54] DEVICE FOR THE INFLATION OF, MORE PARTICULARLY, A CONTAINER OR A FLOATING BODY OF AN ITEM OF LIFESAVING EQUIPMENT

[75] Inventor: Stefan Glasa, Hamburg, Fed. Rep. of Germany

[73] Assignee: Bernhardt Apparatebau GmbH u. Co., Fed. Rep. of Germany

[21] Appl. No.: 104,864

[22] Filed: Aug. 10, 1993

[30] Foreign Application Priority Data

Aug. 13, 1992 [DE] Fed. Rep. of Germany ... 9210848[U]

[51] Int. Cl.[5] ..... B67D 5/00

[52] U.S. Cl. ..... 222/5; 441/94; 441/95

[58] Field of Search ..... 222/5, 54; 114/345; 441/93, 94, 95

[56] References Cited

U.S. PATENT DOCUMENTS

| | | | |
|---|---|---|---|
| 3,127,624 | 4/1964 | Kubit et al. . | |
| 3,227,309 | 1/1966 | Segrest . | |
| 3,610,470 | 10/1971 | Waters | 222/5 |
| 4,191,310 | 3/1980 | Bernhardt et al. | 222/5 |
| 5,035,345 | 7/1991 | Janko et al. | 222/5 |

FOREIGN PATENT DOCUMENTS

| | | |
|---|---|---|
| 2715132 | 10/1978 | Fed. Rep. of Germany . |
| 93112948 | 12/1993 | Fed. Rep. of Germany . |

*Primary Examiner*—Gregory L. Huson

*Attorney, Agent, or Firm*—Kelly, Bauersfeld & Lowry

[57] ABSTRACT

A device is disclosed for the inflation of a container or a floating body of an item of lifesaving equipment with compressed gas. The gas content of a compressed gas container sealed with the aid of a diaphragm, is released by opening the diaphragm with an opening striker disposed in a housing. A lever drive comprising a swiveling lever possessing an intermediate member upon which a hand lever also acts, engages the opening striker to place the device reliably into operation. The swiveling lever is two-armed and swivelable about an axis of rotation that is integral with the housing. A first arm of the swiveling lever is supported upon a spring with its free end, and a second arm of the swiveling lever is supported on a housing stop. The second arm is supportable with its free end upon an automatic element. The intermediate member is two-armed and swivelable about an axis of rotation that is integral with the housing. A first arm of the intermediate member can be made to rest against a housing edge and, with the free end of the first arm of the intermediate member, the opening striker is acted upon.

17 Claims, 2 Drawing Sheets

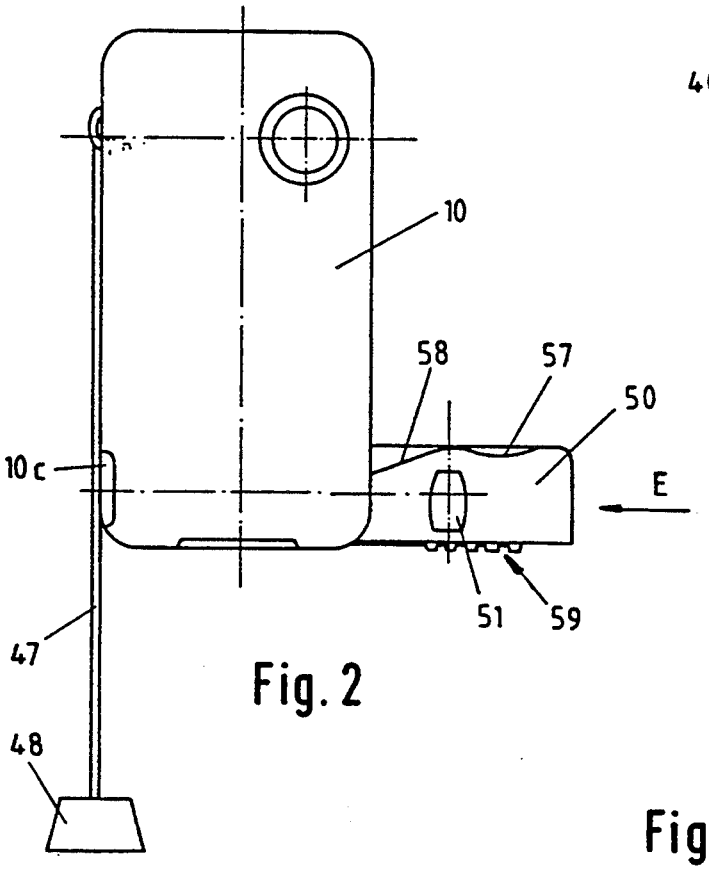
Fig. 2
Fig. 5
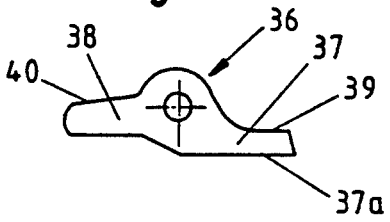
Fig. 6
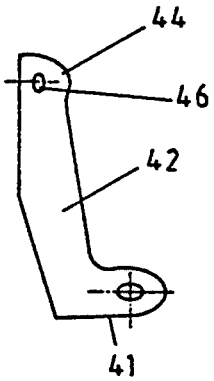
Fig. 4
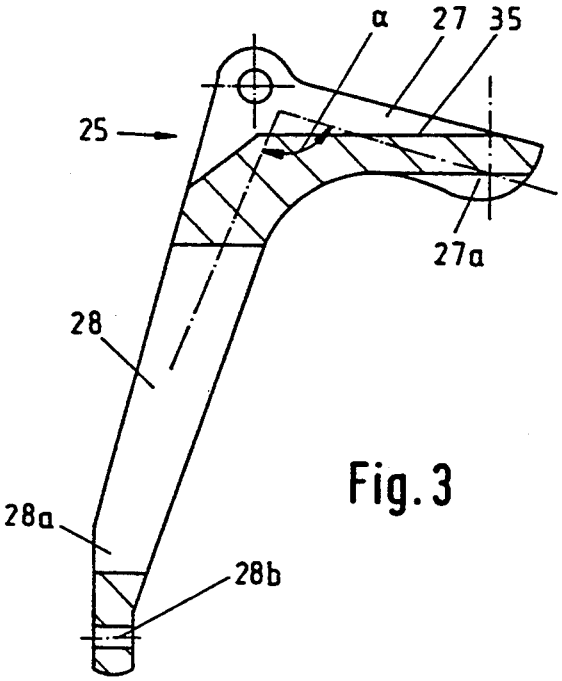
Fig. 3
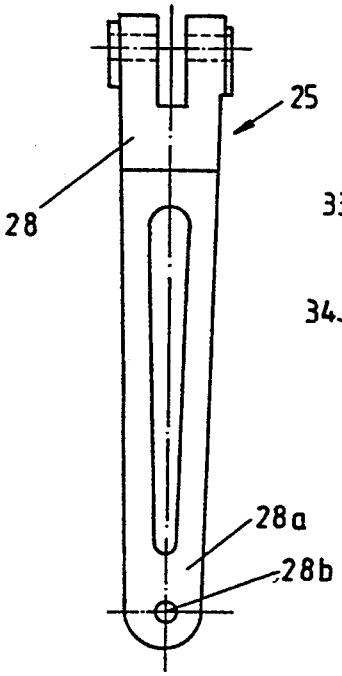
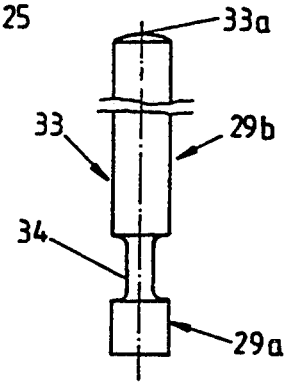
Fig. 7

DEVICE FOR THE INFLATION OF, MORE PARTICULARLY, A CONTAINER OR A FLOATING BODY OF AN ITEM OF LIFESAVING EQUIPMENT

BACKGROUND OF THE INVENTION

The present invention relates to a device for the inflation of a container or a floating body of an item of lifesaving equipment with compressed gas. A diaphragm-sealed compressed gas container, within the region of the container neck, possesses an external thread which, with the container neck, can be screwed into a receiving aperture in a housing which is provided with a corresponding internal thread. The gas content of the compressed gas container is released by opening the diaphragm with the aid of an opening striker disposed in the housing which can be moved both by means of a hand lever as well as by the force of a spring against the diaphragm. The spring is retained in the prestressed position with the aid of an automatic element which loses its solidity in water. A lever drive comprising a swiveling lever acts upon the opening striker. The swiveling lever is provided an intermediate member which is also acted upon by the hand lever.

Automatic means are known which comprise a basic body into which the compressed gas bottle is screwed. In addition, a second, separate part exists there in which a spring element is located which is tensioned by screwing in or by being fitted together and which produces the requisite momentum in order to, in a known manner, by the interposition of a tablet that dissolves in water, drive a pointed striker through the sealing diaphragm so as to open the compressed gas bottled (DE-AS 27 15 132).

In such prior devices, the momentum to be expended is relatively high. Moreover, the initial stressing force, as far as the spring deflection is concerned, has to be fairly accurately harmonized in dependence of the stroke of the compressed gas bottle striker. In the event of a clamping sleeve not having been screwed in completely, it can happen that the compressed gas bottle is not opened or merely incompletely so.

The clamping sleeves of the spring element are separate components which, when being inserted, particularly in the case of a dangerous situation which is restricted in time, can be inadvertently lost, damaged or be subject to contamination. These are all factors which jeopardize the safe operation of such known automatic means.

In contrast to this, the technical problem of the present invention is to reliably render operative a device of the type stated in the beginning as simply as possible with a few operating steps. Furthermore, it should become possible to provide one sole housing possessing the smallest dimensions possible, a low weight and be suitable for an economical manufacture in order to rule out the disadvantages of known type stated in the foregoing. The present invention fulfils these needs and provides other related advantages.

SUMMARY OF THE INVENTION

The main concept in this design consists in that the swiveling lever is constructed in the form of a multiple function lever, with the aid of which all essential operations in the device are carried out. Through this, the device not only becomes small, but also exceedingly reliable in operation.

According to a preferred embodiment, it is provided for a second arm of the swiveling lever to be supported on the automatic element by means of a pin displaceably supported in the housing, in which case the pin can, with its first bearing end, be made to rest against the automatic element and, the second arm of the swiveling lever is hinged on within the region of its oppositely located second end. This pin may serve as an indicator pin for indicating the state of tension. The pin, inside the housing, is displaceable in one direction of movement which, for the direction of the application of power of the spring, possesses an angle of approximately 90° on the first arm of the swiveling lever. This makes it possible for the housing to have very small dimensions and, on the one hand, owing to the resulting momenta, none too great forces are exerted upon a tablet constituting the automatic element and, on the other, great forces are available for the perforation of the diaphragm of the compressed gas container.

The control of the lever drive of the release mechanism of the opening striker is effected by means of the automatic element which loses its solidity in water and which, by preference, is disposed in the housing in the form of a tablet. The tablet interacts with the swiveling lever that is swivelably disposed in the housing, and this in such a way that, when the automatic element is being dissolved, the swiveling lever acted upon spring force thrusts the opening striker upwardly in such a fashion that its point perforates the diaphragm of the compressed gas container so as to release the pressurized gaseous medium. In this case the L-shaped swiveling lever acts by means of an intermediate member. This has the advantage that, without having recourse to further intermediate elements, the hand lever is advantageously able to act upon the same component as the main lever of the release mechanism, viz. the two-armed swiveling lever. By employing the two-armed swiveling lever it is ensured that the one arm of the swiveling lever interacting with the automatic element directly, when being tensioned, is brought forward to the automatic element in a frictionless manner in order to prevent a premature damaging of the automatic element, or, by the reduction of the friction, to contribute to the solidity of the element in such a way that the automatic element is then capable of developing fully when acted upon by water, i.e. is able to immediately lose its solidity in order to actuate the release mechanism of the opening striker.

Particularly advantageous is the construction of the swiveling lever in the form of an L-shaped, two-armed lever since one of the levers acts as the actuating lever of the opening striker and as an absorbing lever of the spring force, and the other lever which interacts with the automatic element acts as a release lever. By means of the L-shape, owing to the circumstance that both arms of the swiveling lever possess an angle of approximately 90° relative to each other, it is possible for the actuation direction of the release lever and the direction of application of power of the spring and, thereby, the direction of movement of the opening striker, to likewise possess an angle of approximately 90° relative to each other. Thus, an extremely space-saving disposition of the individual elements is possible, whereby also a basic position of the device and a release position of the device can be readily realized since it is possible here to produce housing stops by simple means.

By preference, provision is made for the second arm of the swiveling lever to be supported with the aid of a pin displaceable supported on the automatic element, in which case the pin, with its first bearing end, can be caused to rest upon the automatic element and that, within the region of its oppositely located second end, the second end of the swiveling lever is hinged on. By the interposition of a pin between one of the swiveling lever arms and the automatic element, an improved geometry and disposition are provided inside the device. Further, the pin can, with aid of simple means, be constructed so as to serve as an indicator pin which can then be used to indicate the state of tension of the device.

It is advantageously provided that the automatic element is disposed within a chamber in the housing. It will have to be arranged in this connection that, via a closable filling aperture, the chamber is accessible for the insertion of the automatic element and that the chamber possesses an aperture for supplying water and a corresponding pressure equalization aperture for drawing off the air. By preference, provision is made in this connection that the chamber for the automatic element is constructed in a slide-in casing constructed in a drawer-like fashion which is slidable into an appropriate slide-in casing receiving aperture or recess. This slide-in casing can, for example, be retained by means of a force fit in the recess constructed in the housing. The spring is constructed in the form of a compression spring, displaceable within the housing, but retained so as to be indisplaceable. The first terminal section of the spring is disposed in such a way that the same acts upon the first arm of the swiveling lever, while the second terminal section located opposite the first terminal section, is constructed in the form of a locking element. The second terminal section is disposed in an accommodation opening for a locking element in the slide-in casing in such a way as to be engageable for safetying the retention of the same.

The sliding in movement of the slide-in casing with the automatic element leads to the pin being displaced from its normal position. For this it is provided that the slide-in casing possesses an entry aperture for supporting the second arm of the swiveling lever or of the pin on the automatic element. In this latter case, the second arm of the pin, when released by the automatic element, executes a swiveling or sliding movement and, with the aid of the opening striker, brings about the opening of the diaphragm of the compressed gas container. This construction is particularly advantageous insofar as the pin is not displaced when no automatic element is inserted as directed. On the one hand this results in that, for the operator, the sliding-in resistance to be expected does not occur and that, on the other hand, the sliding-in casing does not snap in properly. When the automatic element has not been correctly inserted, it is not possible to pretension the spring by means of the swiveling lever so that no snapping in of the slide-in casing can then take place.

The bringing out of the pin occurs only if the pin is displaced with the aid of the automatic element and thus is pushed out of an opening from the housing with its indicating end.

In order to be able to carry out the tensioning of the spring by means of the slide-fit casing, it is provided that the slide-in casing possesses an oblique sloping sliding surface. This surface extends from a housing point into the region of the receiving aperture for the locking element, upon which the locking element, when the slide-in casing is pushed in, is slidingly displaceable into a spring tensioning means. On this occasion the slide-in drawer is provided with a surface that is beveled according to the desired slide-in resistance, which then, by means of a pertinent displacement of the terminal spring section in the direction of the spring action, results in an adequate pretensioning of the spring.

All the operations explained in the foregoing are in this case carried out by means of the L-shaped swiveling lever so that its construction in the form of a multifunctional lever for the desired operations of tensioning the device, of moving an indicator for the indication of the state of the tension and filling, of controlling the device by means of a tablet, and of releasing the device with the aid of a manual release, is actually made possible.

The swiveling lever is in this case constructed in the form of a plastic lever so that no great forces due to inertia and momenta occur either. However, since it is necessary to transmit the releasing forces transmitted by the lever drive, produced by the spring and amplified by means of the lever drive pointwise onto the opening striker, it is advantageously provided that the intermediate member is fabricated from metal so that, within the region of possible wear, the same is avoided by the specific selection of the material.

Other features and advantages of the present invention will become apparent from the following more detailed description, taken in conjunction with the accompanying drawings which illustrate, by way of example, the principles of the invention.

BRIEF DESCRIPTION OF THE DRAWINGS

An embodiment of the invention is explained in greater detail below with the aid of the drawings. In the drawings:

FIG. 2 shows, in a non-sectioned illustration, the device according to FIG. 1 with the slide-in casing in the extended state;

FIGS. 3 & 4 show the swiveling lever in two views turned through 90°;

FIG. 5 shows the intermediate member in a side view;

FIG. 6 shows the hand lever in a side view; and

FIG. 7 shows the pin serving as indicator pin in a top view.

DETAILED DESCRIPTION OF THE PREFERRED EMBODIMENT

Figure 1:
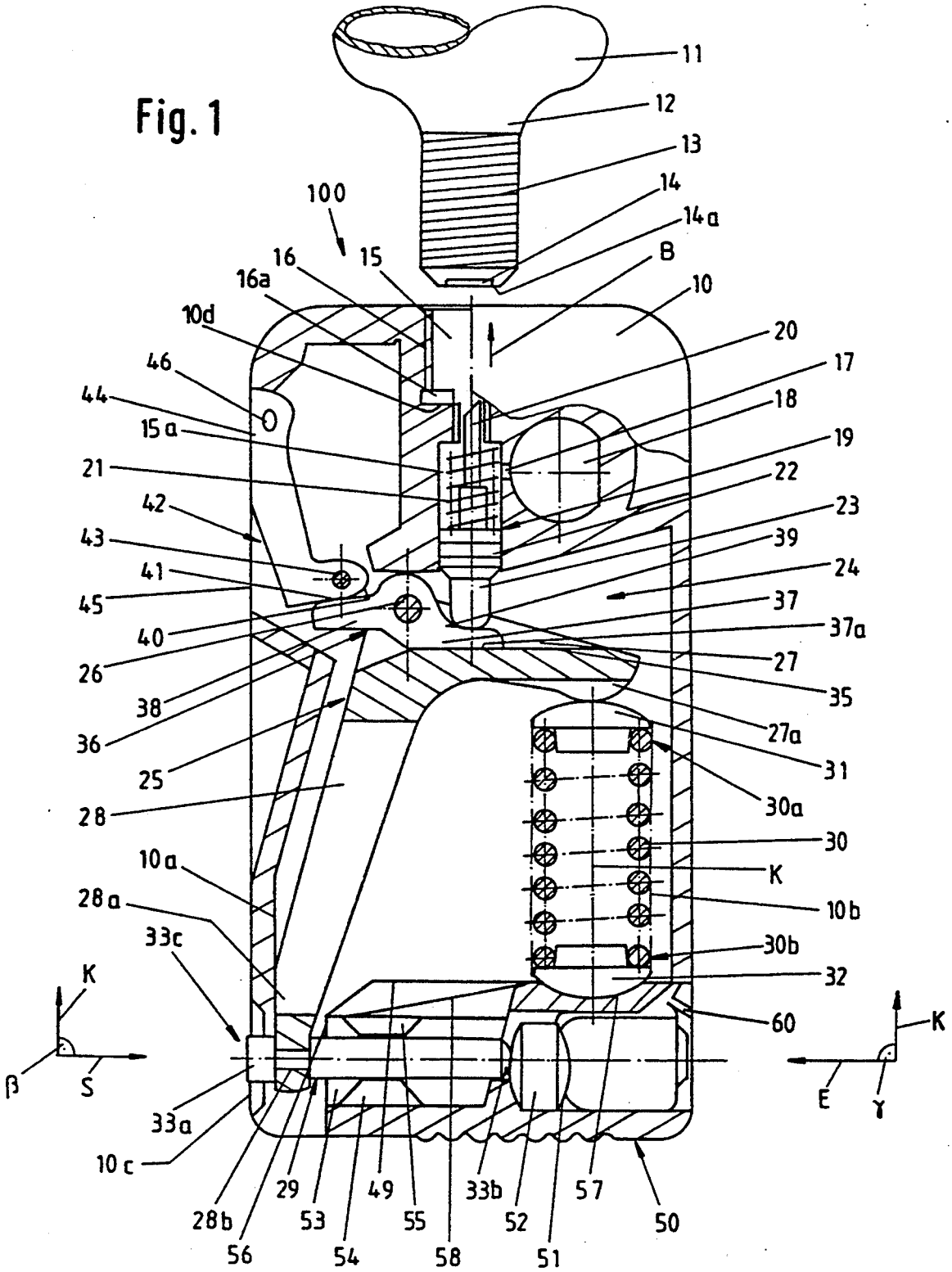
FIG. 1 shows in a vertical partially sectioned illustration, the inflation device of the present invention.

In FIG. 1, a device 100 for inflating a floating body of an item of lifesaving equipment (not shown) with compressed gas is illustrated in a partial longitudinal section, in which the device is depicted in a tensioned state, wherein the compressed gas container 11, which is normally screwed in, is shown in the unscrewed state for the sake of a better visualization. The compressed gas container 11, which is constructed in the form of a compressed gas bottle, is, within the region of the container neck 12, provided with an external thread 13 and sealed by means of a diaphragm 14. In a housing bore 15 which, in its top section is provided with an internal thread 16 and which, within the region of a housing edge **10*b* is provided with a seal 16*a* as a stop for the front-side rim 14*a* and which can be caused to communicate via a branch duct 17, via an air supply connection piece 18, with a non-depicted item of lifesaving equipment to be inflated, an opening striker 19 is disposed in a lever section 15***a*. The opening striker, in its normal position, reaches as far as into the region of the front side 14*a* of the compressed gas container 11 so that the point 20 of the opening striker 19 is located just below the diaphragm 14. In this case the opening striker is retained by a compression spring 21 which is supported upon the opening striker 19 and on the housing 10 in such a way that the point 20 of the opening striker 19 is unable to inadvertently pierce the diaphragm of the compressed gas container 11. Subsequent to the release, the same spring 21 returns the opening striker 19 into its initial position shown in the drawing so that, after the diaphragm 14 has been perforated, the pressurized gas or the compressed air from the compressed gas container is able to flow forth from the compressed gas container and to flow via the housing bore 15*a* and the branch duct 17.

For the actuation of the opening striker 19, which, on its end located opposite the end which carries the point 20, is provided with an annular flange 22 as a supporting surface for the spring 21 and, therebelow, an actuating cam 23, a special lever drive 24 is constructed in the housing 10. This is provided with a two-armed, L-shaped swiveling lever 25 (FIGS. 3 and 4) which is swivelable about an axis 26 that is integral with the housing and whose two arms 27, 28 possess, relative to each other, an angle alpha of approximately 90°. The first arm 27 of the swiveling lever 25 is supported with its free end 27*a* on the main or pretensioning spring 30, while the second arm 28, with its end 28*a*, which, when the device 100 is tensioned, bears against the housing inner wall 10*a* of the housing 10 owing to the action of the spring 30, is connected to the pin 20 acting as an indicator.

The spring 30, which is retained in a spring accommodation recess 10*b* of the housing 10 so as to be displaceable, but in an undetachable manner, is, at its ends 30*a*, 30*b*, provided with screw-head or bolt-head-like terminal sections 31 and 32. The first terminal section 31 is disposed within the region of the end 30*a* of the spring and is acted upon by the terminal section 27*a* of the arm 27 of the swivelling lever 25 and transmits the spring force from the spring 30 to the arm 27. At its other end 30*b*, the spring 30 is provided with the second terminal section 32 which serves as a locking element for the slide-on casing 50 and as tensioning element for the spring 30.

The indicator pin 29 is comprised of a bolt or shank-like basic body 33 having an annular groove-like constriction 34 (FIG. 7), in which the terminal section 28*a* of the second arm 28 having a passage aperture 28*b* embraces the pin 29. The construction 34 is in this case constructed within the region of the one end 33*a* of the pin 29, while the other end 33*b* is provided as a bearing surface for the automatic element 52. For assembly-related reasons, the pin 29 may be comprised of two parts 29*a*, 29*b* that can be screwed together, but provision can also be made for the passage aperture 28*b* to be provided with a receiving slot for introducing the narrow shank section not depicted in the drawing within the region of the constriction 34 into the passage aperture 28*b*.

On its first arm 27, the swiveling lever 25 is provided with a shoulder-like bearing edge 35, against which a first arm 37 of an intermediate member 36 (FIG. 5) constructed in the form of a two-armed lever rests in the tensioned state, whose two arms 37, 38 possess an angle of 180° relative to each other. The intermediate member 36 is, in the preferred embodiment, likewise disposed so as to be swivelable about the housing axis. It is also possible, however, for a disposition on a separate axis integral with the housing to be provided. The first arm 37 of the intermediate member 36 rests, in the tensioned state, with the bearing surface 37*a* against the bearing edge 35, while on a bearing surface 39 located opposite the bearing surface 37*a* of the arm 37 of the intermediate member 36, the actuating cams 23 of the opening striker 19 rests while being acted upon by the spring 21 so that, when the swiveling lever 25 is moved counterclockwise, its arm 27 moves jointly with the arm 37 of the intermediate member 36 and the actuating cam 23 and, with this, the opening striker.

The second arm 38 of the intermediate member 36 is disposed so as to be offset relative to the first arm 37 in such a way that a counterclockwise swiveling motion of the intermediate member 36 without the second arm 38 with the swiveling lever 25 is possible in order to move the opening striker 19 to such an extent that its point 20 penetrates into the diaphragm 14. For this, the second arm 38 is made to rest with a bearing surface 40 against a sliding surface 41 of a hand lever 42 (FIG. 6) which is constructed in the form of an angle lever and is swivelable about a stationary housing axis 43. The free end 44 of the hand lever 42 is disposed in such a way that the same can be passed out from the housing 10 through a housing aperture 45 and possesses a preformation 46 for the attachment of a traction strap 47 with a handle 48 for a manual release (FIG. 2): When the hand lever 42 is swiveled counterclockwise about the axis 43, the intermediate member 36 is turned in the same direction of rotation and moves the opening striker 19 with the point 20 into the diaphragm 14.

In the lower part of the housing 10, a slide-in casing receiving aperture 49 is provided which serves to accommodate the slide-in casing 50. The slide-in casing is constructed approximately in the manner of a drawer and is guided by a non-depicted guiding means in the direction of insertion E, in which case the direction of insertion E possesses, relative to the direction of movement B of the opening striker 19, an angle gamma of approximately 90°. The slide-in casing 50 is provided with the recess 51 in the form of a pocket-like accommodation space for the automatic element 52, which can be inserted via a closable filling aperture in the recess 51. The recess 51 communicates by means of a non-depicted water inflow aperture and a likewise non-depicted ventilation aperture with the housing outside so as to enable water to flow into the recess 51. The slide-in casing 50 possesses an entry aperture 53 for the pin 29, in which connection, in the tubular entering aperture 53, at least two sliding cams 54, 55 or a non-depicted slip ring for guiding the pin 29 are disposed in the entering aperture 53 which guide the pin 29 when moved in the entering aperture 53 or when the slide-in casing 50 is moved. On its outside, the slide-in casing 50 is provided with an oblique sliding surface 58 extending from the casing point 56 as far as into the region of a locking element accommodation aperture 57. On the surface of the slide-in casing located opposite the sliding surface 58, a grooving 59 is provided to facilitate the displacement of the slide-in casing 50.

Provision has been made for the pin 29 to project in the form of an indicator in the pretensioned position of the device 100 with its second end 33*a* located opposite the bearing end 33*b* through an opening 10*c* from the housing 10 for indicating the state of tension, so that then, from the outside, the marking applied to this section 33, e.g. in the form of a green coat of color, becomes clearly perceivable.

The interaction of the parts takes place in a completely problem-free manner and with a high degree of reliability since all movements are effected with a minimum of components and since, due to the right-angled disposition of the direction of insertion E of the slide-in casing 50 to the direction of the dynamic effect K of the spring 30, on account of the likewise right-angled disposition of the two arms 27, 28 of the swiveling lever relative to each other and the likewise right-angled disposition of the direction of movement S of the indicator pin 29 relative to the direction of the dynamic effect K of the spring 30, a disposition within the smallest space of the components with, at the same time, optimal lever conditions, can be achieved. In this case it is 18 advantageously provided that the swiveling lever 25, which constitutes a relatively large component, is comprised of plastic in order to avoid great angular momenta, while the intermediate member 36 which, with its relatively short arms 37, 38 has to transmit forces and momenta in order to avoid errors due to elasticity and so as to avoid wear in a sliding stress, is comprised of metal.

To this is further added the circumstance that, by the performance of the tensioning operation with the aid of the components available anyhow, a further reduction of the requisite component parts is achieved, while an additional safety factor with regard to the mode of operation exists since an operating error is ruled out.

In this case the device 100 is operated as detailed in the following.

The compressed gas container 11 is, with the compressed gas container neck 12, screwed into the internal thread 16 of the housing bore 15 with the aid of the external thread 13 provided on said container neck 12. The opening striker 19 and, more particularly, the point 20, have, by the action of the compression spring 21, been pressed downward to such an extent within the lower section **15*a* of the housing bore 15 that the point 20 is located in the region of the diaphragm 14. The point 20 is, however, incapable of unintentionally penetrating the diaphragm 14 of the compressed gas container 11. The same compression spring 21 which, on the one hand, is supported upon the annular flange 22 and, on the other, on a housing edge of the lower section 15*a* of the housing bore 15*a*, subsequent to the release, returns the opening striker 19 into its initial position illustrated in FIG. 1 so that, after the diaphragm 14 has been perforated, the pressurized gas or the compressed air is able to flow forth from the compressed gas container and to flow, via the branch duct 17 and the air supply connection piece 18**, into the non-depicted item of lifesaving equipment.

In the non-tensioned state of the device 100, the free end **28*a* of the arm 28 of the swiveling lever does not bear against the housing inner wall 10, but the swiveling lever 25 is subject to the action of the as yet non-tensioned, but by a certain amount initially prestressed spring 30. The swiveling lever 25 is rotated clockwise until a state of equilibrium between the pretension of the spring 30 and the spring force of the compression spring 30 is produced. The indicator pin 29 disposed on the free end 28*a* is in this state still pertinently withdrawn and that is why only the section 33*b* of the indicator pin 29 is not visible either within the region of the housing aperture 10*c***.

When, in this non-tensioned state, the compressed gas container 11 is inadvertently screwed in, then, by the dimensioning of the spring forces, it may be provided that the spike 20 piercingly penetrates the diaphragm 14 and the compressed gas container is thus discharged, which indicates an operating error to the operator. Provision can also be made for the spring forces to be dimensioned in such a way that the spike 20 does not damage the diaphragm 14 since, after all, the operator will ascertain from the still missing indication that the device still is in the non-tensioned state.

The tensioning of the device is brought about in that the slide-in casing 50 is inserted in the direction of insertion E into the slide-in casing receiving aperture 49. For this, pertinent guideways are provided which are not shown in the drawing. When inserting the slide-in casing 50, the bearing end **33*b* of the indicator pin 29 enters into the entry aperture 53 of the slide-in casing 50 and is, in the process, guided by the sliding cams 54, 55 until it impinges upon the automatic element 52 inserted into the recess 51, the automatic element 52 having the form of a water-soluble tablet. This impingement of the bearing end 33*b* upon the automatic element 52 takes place prior to the slide-in casing 50 having been inserted completely into the slide-in casing receiving aperture 49. In the course of a further insertion of the slide-in casing 50 into its terminal position shown in FIG. 1, the indicator pin 29 is then jointly displaced in the direction of insertion E so that the section 33*c* on the end 33*a* of the indicator pin 29 issues through the housing aperture 10*c* and indicates that the slide-in casing 50** is in its correct position.

However, when the slide-in casing 50 is inserted, the tensioning of the device 100 has taken place at the same time. For this, the slide-in casing 50, on its side facing the spring 30, is provided with a sliding surface 58 extending from the casing point 56 of the slide-in casing 50, which proceeds in an obliquely ascending fashion and upon whose initial section within the region of the casing point 56, the terminal section 32 of the spring 30 is placed. During the further insertion of the slide-in casing 50, the terminal section 32 slides on the sliding surface 58 and the compression spring 30 is tensioningly raised in the process. At the end of the sliding surface 58 which faces away from the casing point 56, in the slide-in casing 50, the locking element receiving aperture 57 is disposed which, in its configuration, corresponds to the shape of the terminal section 32 which, by snapping in here, at the same time assumes the function of a snap-in safetying of the slide-in casing 50. A certain relief of the compression spring 30 is brought about hereby, the pretension achieved by this does however suffice for ensuring an adequate release force. In order to facilitate the insertion of the slide-in casing 50, by means of which the pretensioning force has after all to be applied, a grooving 59 is provided on the slide-in casing 50 on the side of the latter located opposite the sliding surface 58.

In the thusly tensioned state, the force of the spring 30 is transmitted via its end **30*a* onto the terminal section 30 which bears against the free end 27*a* of the arm 27 of the swiveling lever 25. In the process, the compressive force of the spring 30 tries to produce an anti-clockwise rotation of the swiveling lever 25 about the axis of rotation 24. However, the second arm 28 of the swiveling lever 25 is retained by means of the indicator pin 29** which, in turn, is supported upon the automatic element 52. Since the effective length of the second arm 28, compared with the effective length of the first arm 27 with regard to the points of application of power about the axis of rotation 26 is approximately twice as great, the force applied to the automatic element 52 is kept within the necessarily predetermined limits.

While subject to the action of the compressive spring 30 which is supported on the housing and which transmits the compressive force to the annular flange 22, the actuating arm 23 is pressed onto the first arm 37 of the intermediate member, which, in turn, is supported upon the should-like bearing edge 35 of the swivelling lever 25. At the same time, the second arm 38 of the intermediate member 36 is made to bear against the hand lever 42 within the region of its sliding surface 41 so that the hand lever 42 assumes its position depicted in FIG. 1 and a contact free of play exists between all elements.

When water now penetrates into the recess 51 in the slide-in casing 50, by way of example, via an inflow aperture 60, a sudden disintegration of the automatic element 35 takes place. Subsequent to the disintegration of the automatic element 52, the indicator pin is able to move further into the slide-in casing 50 into the recess 51. Due to the action of the compression spring 30, the swiveling lever 25 is swiveled counterclockwise, whereby the intermediate member 36 is swiveled about the axis of rotation in the same direction of rotation and, by means of the actuating cam 23 and the opening striker 19, the point 20 is moved into the diaphragm 14, perforating the same in the process.

Owing to the effect of the pressure of the compressed gas in the compressed gas container 11 then acting upon the point 20 of the opening striker 19, the opening striker 19 is moved back so that the compressed gas is able to flow forth from the container 11 and into the housing aperture 15*a* and then on farther, via the branch duct 17 into the air supply connection piece 18. However, this return movement of the opening striker 19 does not go so far that the free end 28*a* is again made to bear against the housing inner wall 10*a* so that the section 33*c* does not issue from the housing aperture 10*c* either and indicates that the device is ready for use. With this, the operator is able to perceive that the device 100 is in the released state.

For putting the device into operation once more, the compressed gas container 11 will have to be replaced and the slide-in casing 50 to be pulled out and, subsequent to a new automatic element 52 having been inserted, it will have to be inserted again into the slide-in casing receiving aperture 49.

The hand lever is provided for the event of an automatic release not taking place for any reason whatever, or if the release of the device were to take place without any water entering. By means of the traction strap 47 depicted in FIG. 2, by pulling on the handle 48, a swiveling of the hand lever 42 about the housing axis 43 in the counterclockwise direction can be achieved. By means of the sliding surface 41, the intermediate member 36 is then rotated about the housing axis 26 likewise in the counterclockwise direction and, with the aid of the actuating cam 23, actuates the opening striker 19 in such a way that the diaphragm 14 is perforated and the operating sequence described in the foregoing results.

By means of the advantageously provided use of the intermediate member 36, a release of the device 100 is possible without it being necessary to apply the force by means of the hand lever which would be necessary for destroying the automatic element 52. That is why a very easy manual release is possible, whereby the reliability of the device is increased.

Although a particular embodiment of the invention has been described in detail for purposes of illustration, various modifications may be made without departing from the spirit and scope of the invention. Accordingly, the invention is not to be limited, except as by the appended claims.

What is claimed is:

1. A device for the inflation of a container or a floating body of an item of lifesaving equipment with compressed gas from a compressed gas container sealed by a diaphragm, the inflation device comprising:

a housing having a receiving aperture into which a neck of the compressed gas container can be placed;

an opening striker disposed in the housing and movable therein so as to engage the diaphragm when the compressed gas container is placed within the housing receiving aperture, to release the gas content of the container;

hand lever means at least partially positioned within the housing, for moving the opening striker against a diaphragm;

spring means positioned within the housing, for moving the opening striker against the diaphragm, the spring means being retained in a pretensioned position with the aid of an automatic element which loses its solidity in water; and a lever drive which acts upon the opening striker, the lever drive including a swiveling lever provided with an intermediate member, wherein the intermediate member is acted upon the hand lever means to move the opening striker against the diaphragm, characterized in that:

the swiveling level is swivelable about an axis of rotation which is integral with the housing, the swiveling lever including a first arm and a second arm, wherein a free end of the first arm is supported upon the spring means, and wherein the second arm, in a non-tensioned and not-as-yet-released position of the lever drive, is supported upon a housing stop, and further wherein a free end of the second arm, in the tensioned and not-as-yet-released position of the lever drive, can be supported upon the automatic element; and the intermediate member is swivelable about an axis of rotation which is integral with the housing, the intermediate member including two arms, wherein the first arm of the intermediate member can be caused to bear against a shoulder-like bearing edge of the first arm of the swiveling lever, and wherein the opening striker can be acted upon by a free end of the first arm of the intermediate member.

2. A device according to claim 1, wherein the hand lever bears upon the second arm of the intermediate lever.

3. A device according to claim 1, wherein:

the second arm of the swiveling lever, by means of a pin that is displaceably disposed in the housing, is supported upon the automatic element, in which case the pin, with its first bearing end, bears against the automatic element and, within the region of its oppositely located second end, the second arm of the swiveling lever is hinged on;

the pin is displaceable inside the housing in a direction of movement which, relative to the direction of application of power of the spring, exhibits an angle beta of approximately 90° on the first arm of the swiveling lever; and the housing is provided with a recess in the form of a pocket-like receiving aperture for the accommodation of the automatic element and in that the recess is constructed in a drawer-like slid-in casing, which is insertable into a slide-in casing inserting aperture.

4. A device according to claim 1, wherein the second arm of the swiveling lever, by means of a pin that is displaceably disposed in the housing, is supported upon the automatic element, in which case the pin, with its first bearing end, bears against the automatic element and, within the region of its oppositely located second end, the second arm of the swiveling lever is hinged on.

5. A device according to claim 4, wherein the pin is displaceable inside the housing in a direction of movement which, relative to the direction of application of power of the spring, exhibits an angle beta of approximately 90° on the first arm of the swiveling lever.

6. A device according to claim 5, wherein the pin, in the predetermined position of the device, with its second end located opposite the bearing end, is, through an opening, passed out from the housing for indicating the state of tension.

7. A device according to claim 1, wherein the housing is provided with a recess in the form of a pocket-like receiving apparatus for the accommodation of the automatic element and in that the recess is constructed in a drawer-like slide-in casing, which is insertable into a slide-in casing inserting aperture.

8. A device according to claim 7, wherein the slide-in casing possesses an entering aperture for supporting the second arm of the swiveling lever or of the pin upon the automatic element, in which case the second arm or the pin, when released by the automatic element, executes a swiveling or sliding movement and, with the aid of the opening striker, brings about the opening of the diaphragm of the compressed gas container.

9. A device according to claim 8, wherein the slide-in casing, in the entering aperture, is provided with two sliding cams for the guidance of the pin.

10. A device according to claim 8, wherein the direction of the insertion of the slide-in casing, relative to the direction of movement of the opening striker, exhibits an angle gamma of approximately 90°.

11. A device according to claim 10, wherein the spring means is constructed in the form of a compression spring, is retained in a spring receiving recess in the housing so as to be displaceable, but retained so as to be immovable and, with its first terminal section, is disposed so as to be capable of acting upon the first arm of the swiveling lever, while a second terminal section located opposite the first terminal section, is constructed in the form of a locking element, which is disposed so as to be engageable into an accommodation opening for a push-to lock element for safetying the mounting of the same.

12. A device according to claim 11, wherein the slide-in casing is provided with an oblique sliding surface which extends from the casing point into the region of the accommodation opening for the locking element, upon which the locking element is slidingly displaceable into a spring pretensioning direction when the slide-in casing is inserted.

13. A device according to claim 12, wherein the pin, in the pretensioned position of the device, with its second end located opposite the bearing end, is, through an opening, passed out from the housing for indicating the state of tension.

14. A device according to claim 7, wherein the direction of the insertion of the slide-in casing, relative to the direction of movement of the opening striker, exhibits an angle gamma of approximately 90°.

15. A device according to claim 7, wherein the spring means is constructed in the form of a compression spring, is retained in a spring receiving recess in the housing so as to be displaceable, but retained so as to be immovable and, with its first terminal section, is disposed so as to be capable of acting upon the first arm of the swiveling lever, while a second terminal section located opposite the first terminal section, is constructed in the form of a locking element, which is disposed so as to be engageable into an accommodation opening for a push-to lock element for safetying the mounting of the same.

16. A device according to claim 15, wherein the slide-in casing is provided with an oblique sliding surface which extends from the casing point into the region of the accommodation opening for the locking element, upon which the locking element is slidingly displaceable into a spring pretensioning direction when the slide-in casing is inserted.

17. A device according to claim 16, wherein the pin, in the pretensioned position of the device, with its second end located opposite the bearing end, is, through an opening, passed out from the housing for indicating the state of tension.

* * * * *